US006066194A

United States Patent [19]

Hugghins et al.

[11] Patent Number: 6,066,194

[45] Date of Patent: May 23, 2000

[54] ELECTRONIC ROOM AIR CLEANER WITH VARIABLE SPEED MOTOR

[75] Inventors: Gordon J. Hugghins, Jacksonville; Robert W. Helt, Tyler, both of Tex.

[73] Assignee: American Standard Inc., Piscataway, N.J.

[21] Appl. No.: 09/062,201

[22] Filed: Apr. 17, 1998

[51] Int. Cl.[7] ..... B03C 3/00

[52] U.S. Cl. ..... 96/397; 55/473

[58] Field of Search ..... 55/385.2, 467, 55/473; 62/129; 417/20, 42; 96/20, 397

[56] References Cited

U.S. PATENT DOCUMENTS

| | | | |
|---|---|---|---|
| Re. 34,549 | 2/1994 | Sun . | |
| 2,990,911 | 7/1961 | Lippincott . | |
| 4,261,712 | 4/1981 | Kinkade | 55/126 |
| 4,539,896 | 9/1985 | Thomas . | |
| 4,836,095 | 6/1989 | Wright, Jr. . | |
| 5,061,296 | 10/1991 | Sengpiel et al. | 55/4 |
| 5,244,480 | 9/1993 | Henry | 55/213 |
| 5,289,094 | 2/1994 | Young . | |
| 5,447,414 | 9/1995 | Nordby et al. | 318/432 |
| 5,461,368 | 10/1995 | Comer | 340/607 |
| 5,538,181 | 7/1996 | Simmons et al. . | |
| 5,544,809 | 8/1996 | Keating et al. . | |
| 5,673,022 | 9/1997 | Patel . | |
| 5,689,963 | 11/1997 | Bahel et al. | 62/129 |

OTHER PUBLICATIONS

The Trane Company, "Perfect Fit™ Air Cleaner", Pub. No. 22–8650–31, Feb. 1998.

*Primary Examiner*—Harold Joyce
*Attorney, Agent, or Firm*—William J. Beres; William O'Driscoll; Peter D. Ferguson

[57] ABSTRACT

An apparatus and method for using a programmable variable speed motor to indicate a clogged filter while providing a constant airflow across a wide range of restrictions. A motor has speed and airflow parameters and a built-in constant airflow regulator. A blower unit is connected to the motor to draw air from the inlet to the outlet. A filter reduces airborne particles as air is forced from the inlet to the outlet by operation of the motor and blower. A control system adjusts the airflow parameter of the motor based on the motor speed and environmental conditions such as light and motion. If an electronic air cleaner filter is employed, a discharge counter counts the frequency of pops occurring across the electrodes of that filter. The control system adjusts the voltage across those electrodes based on the discharge counter values.

13 Claims, 1 Drawing Sheet

ELECTRONIC ROOM AIR CLEANER WITH VARIABLE SPEED MOTOR

CROSS-REFERENCE TO RELATED APPLICATIONS

None

STATEMENT REGARDING FEDERALLY SPONSORED RESEARCH OR DEVELOPMENT

Not Applicable

BACKGROUND OF THE INVENTION

This invention relates to an apparatus for delivering a constant airflow across a wide range of restrictions. More particularly, the invention relates to an electronic room air cleaner having a programmable variable speed motor with a built-in constant airflow control for providing a constant airflow in a room and for indicating the presence of a clogged filter.

Smog, dust, pollen, dirt, germs, smoke, and other airborne impurities contaminate the air we breathe. These contaminants can adversely affect our health and comfort, particularly as they are present in our offices and homes. Thus, homes and commercial buildings have employed some form of an electronic room air cleaner to improve the quality of the air we breathe.

Virtually all electronic room air cleaners include a filter to remove dirt, dust, and other unwanted airborne particles from the air within a room. Over time, the filter becomes clogged as the trapped particles accumulate on its surface. This phenomenon is referred to as restriction because, as the filter becomes increasingly clogged, the airflow through the filter is increasingly restricted. When the filter becomes so clogged that the electronic room air cleaner ceases to operate efficiently, it must be cleaned or replaced. But it is difficult to ascertain when a filter needs cleaning or replacement. The rate at which the filter accumulates material depends on many factors such as the season, the activity within the building, the location of the building, the size of the room, and so forth. For example, an air cleaner located in a high-pollen or particularly dusty area will clog more rapidly than it would if located in a low-pollen or low-dust area and therefore require servicing at an earlier time.

A clogged filter restricts airflow in the room. As the airflow in the room decreases, the electronic air cleaner filters less and less air, which causes an undesirable buildup of contaminants in the surrounding air. Current electronic air cleaners are incapable of sustaining a constant airflow over a wide range of different degrees of restriction.

Most electronic air cleaners are capable of detecting a clogged filter by sensing an air pressure differential across the filter. As the filter becomes increasingly dirty, static pressure builds up across the filter. Sensors measure this static pressure, and when the pressure exceeds a predefined limit, the air cleaner unit notifies the operator (usually by means of an alarm or a light emitting diode) that the filter needs servicing. The problem with this clogged-filter detection scheme is that it does not maintain the airflow in the room at a constant rate. The airflow is typically allowed to drop to some extent before the operator is alerted to service the filter. Also, premature servicing of the filter can result, particularly where the unit is operating at high airflow rates. The sensors for detecting a clogged filter are usually calibrated to trigger at the lowest airflow, although some systems include a separate sensor for each different airflow.

Multiple sensors increase the complexity and cost of the unit. Single-sensor clogged-filter detection systems make inefficient use of filter media, the most frequently replaced component of such systems.

Therefore a need remains in the industry for an electronic room air cleaner which overcomes the potential disadvantages discussed above while exploiting the advantages of a programmable variable speed motor having a built-in constant airflow algorithm. The present invention as described below addresses this need.

BRIEF SUMMARY OF THE INVENTION

One object of the invention is to provide an apparatus and method for using a programmable variable speed motor to indicate a clogged filter while providing a constant airflow across a wide range of restrictions.

Another object of the invention is to provide an apparatus and method for using a light sensor for detecting ambient light levels near the electronic room air cleaner and adjusting airflow as desired.

A further object of the invention is to provide an apparatus and method for using a motion sensor for detecting activity near the electronic room air cleaner and adjusting airflow as desired.

A still further object of the invention is to detect a clogged filter by providing a discharge counter for counting the frequency of electrostatic discharges across the plates of an electronic air cleaner filter.

Yet another object of the invention is to consolidate the detection of and compensation for clogged filters to a single part.

Still another object of the invention is to reduce the number of parts needed for the detection of and compensation for clogged filters.

A further object of the invention is to optimize the frequency at which filters are serviced.

A still further object of the invention is to alert the operator to service the filter when the filter becomes undesirably clogged.

Another object of the invention is to increase the efficiency of filter media by providing a constant airflow across a wide range of restrictions.

Yet another object of the invention is to substantially reduce the noise output of the electronic room air cleaner over conventional systems employing traditional induction motors by employing a much quieter programmable variable speed motor.

One or more of the preceding objects, or one or more other objects which will become plain upon consideration of the present specification, are satisfied by the invention described herein.

One aspect of the invention, which addresses one or more of the above objects, is a room air cleaner having a motor, a filter, a blower, and an airflow regulator. The filter presents a variable resistance to airflow. The blower is connected to the motor for maintaining an airflow through the filter. Finally, the airflow regulator is operatively associated with the motor for maintaining the flow rate of the airflow through the filter at a substantially constant, nonzero value despite variations in the resistance to flow.

Another aspect of the invention, which addresses one or more of the above objects, is a room air cleaner for providing a constant airflow using a programmable variable speed motor. The room air cleaner includes, but is not limited to, at least one air inlet and outlet, a motor, a constant airflow regulator, a blower unit, and a filter. The constant airflow regulator is operatively associated with at least one of the motor and the blower for delivering a substantially constant, nonzero airflow from the inlet to the outlet despite changes in the flow resistance from the inlet to the outlet. The blower unit is connected to the motor and draws air from the inlet to the outlet. The filter is positioned for filtering the air drawn by the blower unit.

Yet another aspect of the invention, which addresses one or more of the above objects, is a method for providing a constant airflow across a range of restrictions. The method includes the steps of providing a housing defining at least one air inlet and at least one air outlet, a programmable variable speed motor having an adjustable airflow parameter, a blower unit, and a filter for filtering air drawn by the blower unit; programming the motor to maintain at least one desired airflow substantially constant across the filter; and drawing air through the filter by the blower unit at a substantially constant rate.

BRIEF DESCRIPTION OF THE SEVERAL VIEWS OF THE DRAWING

The FIGURE is a schematic diagram of the electronic room air cleaner according to one embodiment of the present invention.

DETAILED DESCRIPTION OF THE INVENTION

Figure 1:
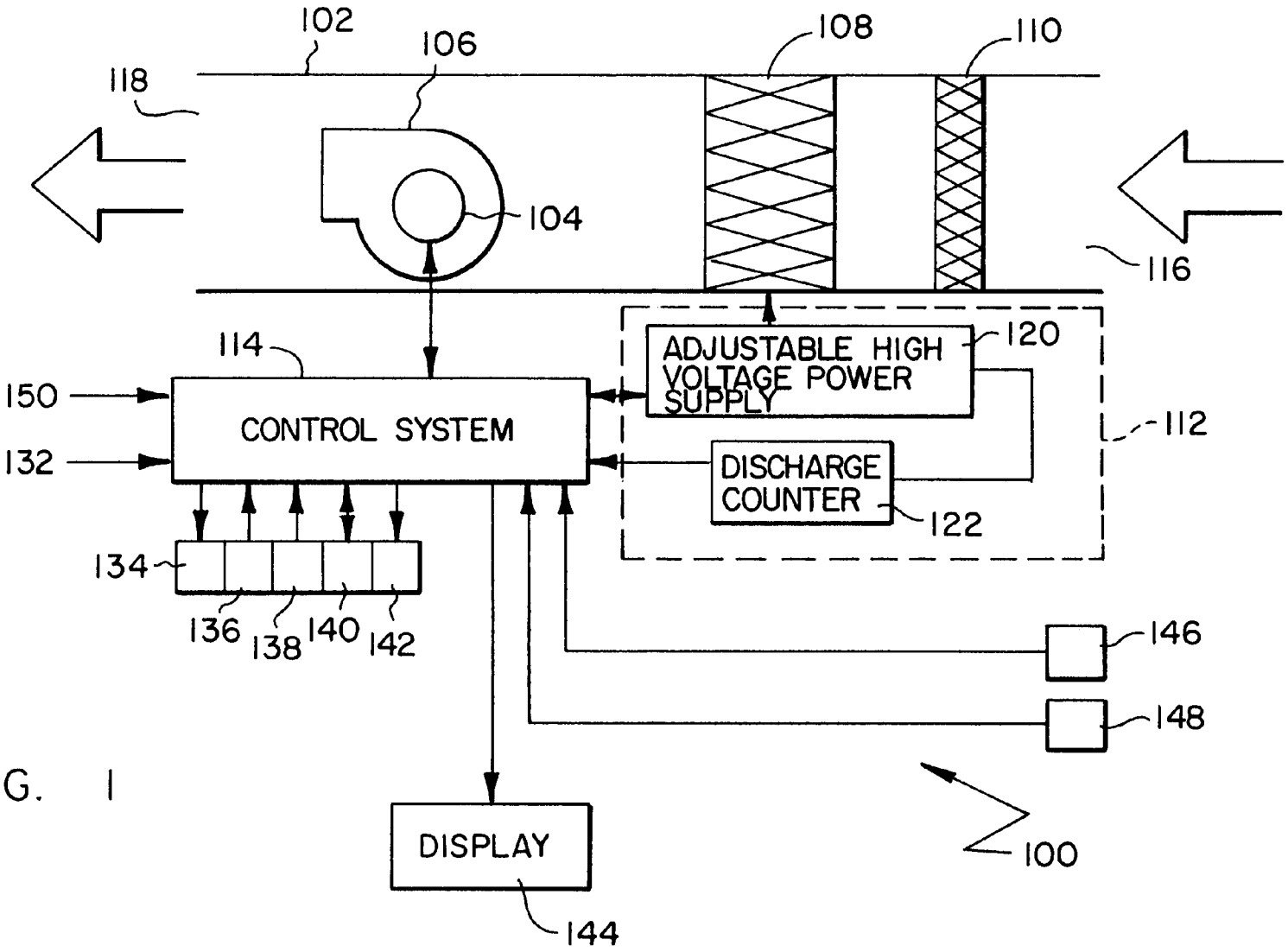

While the invention will be described in connection with one or more embodiments, it will be understood that the invention is not limited to those embodiments. On the contrary, the invention includes all alternatives, modifications, and equivalents as may be included within the spirit and scope of the appended claims.

Referring to the FIGURE, the electronic room air cleaner 100 (also referred to as "the unit") generally comprises a housing 102, a programmable variable speed motor 104, a blower 106, a primary filter 108, a media prefilter 110, an electronic filter circuit 112, and a control system 114. The blower 106 is connected to the programmable variable speed motor 104 and forces air from the inlet 116 to the outlet 118 when the motor 104 is activated. The electronic filter circuit 112 further comprises an adjustable high voltage power supply 120 and a discharge counter 122.

The primary filter 108 can be an electronic air cleaner filter, a high efficiency particulate air ("HEPA") filter, or any other type of commercially available filter. The type of filter used may affect the selection of various other components of the electronic room air cleaner 100. An electronic air cleaner filter operates more effectively with a media prefilter 110, which removes tie larger particles from the air before it is forced against the electronic air cleaner filter, whereas a HEPA filter is quite capable of trapping larger airborne particles. If, for example, only a HEPA filter is used, the media prefilter 110 may be eliminated or removed, and the power supply 120 and the discharge counter 122 may be either eliminated or temporarily disabled.

In a preferred embodiment, the programmable variable speed motor 104 is an ICM2 integrated control motor manufactured by General Electric, although any other comparable programmable variable speed motor may be used. The ICM2 motor may be purchased with ⅓, ½, ¾, or 1 HP (horsepower) ratings. The ICM2 motor has a built-in constant airflow algorithm with speed limit and airflow parameters which makes it particularly suited for this invention. The speed limit set points and desired airflows, which are derived by calculating various airflow constants, must be preprogrammed into the motor 104. The motor 104 includes a power connector (not shown) and a data connector (not shown) which contains bidirectional control signals that interface with the control system 114. This interface permits multiple airflows to be selected by the operator, while simultaneously, for a given selected airflow, maintaining a constant airflow.

The control system 114 as depicted in the FIGURE comprises an input power signal 130, an airflow selector 132, an LED (light emitting diode) 134, a mode selector 136, a day/night selector 138, a timer 140, ar on/off indicator 142, a display unit 144, a light sensor 146, and a motion sensor 148. Not all of these elements need to be present in an embodiment of the present invention, and other components may also be included. The control system 114, which is microprocessor based, interfaces with the motor 104, the power supply 120, and the discharge counter 122. The light sensor 146 and motion sensor 148 are disposed in an unobstructed area of the unit 100 such that the light sensor 146 is capable of measuring the ambient light level of the surrounding environment and the motion sensor 148 is capable of detecting movement near the unit 100. The data from the light sensor 146 and motion sensor 148 are fed into the control system 114 which processes that data and sends any changes in airflow or speed to the motor 104.

An input power signal 150 powers the unit 100 with AC current. In a preferred embodiment, the input power signal 150 comprises the typical 115 VAC outputted from a standard wall outlet. The airflow selector 132 allows the operator to manually select a desired airflow to be maintained at a constant rate. The airflow selector 132 can be a knob or a switch. In a preferred embodiment, the user, by turning the airflow selector 132 knob, can select "off," "low," "medium," or "high" airflow rates. Although four states are mentioned here, it is contemplated that any number of states may similarly be employed.

The LED 134 indicates the status of the filter. When the filter 108 becomes undesirably clogged, the control system 114 will light up the LED 134 to alert the operator to service the filter.

The mode selector 136 is used to select between residential and commercial modes. Because commercial environments tend to have different restriction requirements than do residential environments, a different airflow is needed.

In addition to the mode selector 136, the electronic room air cleaner 100 may further include a day/night selector 138. The day/night selector 138 is used to choose between a day mode, with a relatively high airflow, and night mode, where airflow is reduced. By reducing the airflow in the night mode, power consumption by the unit 100 may be reduced. Because there is less activity at night, so fewer airborne particles are generated, the system may operate more efficiently on the night mode.

The timer 140 is used to change the rate of airflow after a predetermined period of time. For example, the timer 140 may be set to change the airflow from medium to low after a time period set by the operator.

Because the motor 104 operates very quietly, it may be difficult for the operator to ascertain whether the unit 100 is on or off. Thus, the on/off indicator 142 provides a visual indication of the status of the unit 100. The status of the on/off indicator 142 may be displayed on the display unit 144 or may be displayed by an LED (not shown) or by some other suitable method. The display unit 144 may be programmed to display the current time, the status of the on/off indicator 142, mode selector 136, or day/night selector 138, the status of the filter 108, or any other desired information.

Although various selectors are shown in the FIGURE, it is contemplated that other input selectors may also be employed. For example, a selector to disable the light sensor 146 or motion sensor 148, or a selector to switch operation of the electronic room air cleaner 100 from manual to automatic mode may also be interfaced with the control system 114. Because the control system 114 is micioprocessor-based, it can be programmed to handle any number of operational inputs and outputs in any combination.

When an electronic air filter is installed as the primary filter 108, an electric charge is maintained across the plates of the filter. Particles in the air are attracted to the negatively charged plates, and as the number of particles increases, a phenomenon commonly referred to as popping or arcing occurs. The frequency of these pops or arcs is a function of how clogged the filter is. The discharge counter 122 counts these pops or arcs and sends this information to the control system 114.

In operation, the operator can manually select a desired airflow by adjusting the airflow selector 132 or choose automatic operation by changing the mode selector 136, the day/night selector 138, or by setting the timer 140.

In manual operation, for example, if the user selects a "medium" airflow, the control system will send the necessary instructions to the motor 104 for operation at its preprogrammed medium airflow rate. A medium airflow will be sustained until the desired airflow rate is changed either manually by the operator, or automatically by the control system 114.

In automatic mode, for example, the operator may select the residential mode by the mode selector 136 and night mode by the day/night selector 138. The control system processes this information and determines from its preprogrammed memory, which new airflow rate, if any, to send to the motor 104. The motor 104 then adjusts its airflow rate as necessary. However, for any given airflow rate, the airflow rate will be held constant at that rate. Thus, the change in airflow rate, if any, is caused by the operator or by a change in the environment (e.g., the presence of light on the light sensor 146, the absence of motion on the motion sensor 148, the expiration of the timer 140), and not because of a particle build-up on the filter 108.

As is readily apparent, many different combinations are possible in the automatic mode. For example, if the room is dark and movement is detected, and the residential mode is selected, then a medium airflow can be sustained. If, for example, the room is light, no movement is detected, and the residential mode is selected, then a high airflow may be sustained; and so forth. All of these combinations are programmed into the control system 114. Some, but not all, of the possible combinations are listed in Table 1 below (the trigger conditions are indicated parenthetically).

TABLE 1

| System status | Residential mode | Commercial mode |
|---|---|---|
| Off | off | off |
| manual | low1/med1/high1 | low2/med2/high2 |
| Automatic | low1 (dark) | low2 (light + movement) |
| | medium1 (dark + movement) | medium2 (dark + movement) |
| | medium1 (light) | medium2 (light) |
| | high1 (light + movement) | high2 (dark) |
| Discharge counter | low1/med1/high1 | low2/med2/high2 |

Note that the airflow rates low1, med1, and high1 may be equivalent to, or different from, airflow rates low2, med2, and high2.

As the motor 104 adjusts its speed, air is drawn by the blower 106 from the inlet 116 to the outlet 118 at a constant rate. As particle matter builds up on the filter 108, the speed of the motor 104 increase; to compensate for the increased airflow resistance of the filter 108. When the speed of the motor 104 reaches its preprogrammed set point, the motor 104 sends a signal to the control system 114 that a speed alarm limit has been reached. The control system 114 activates the LED 134 to warn the operator that the filter requires servicing. As particle matter continues to build up on the filter 108, the motor speed may increase to a second preprogrammed value which instructs the control system 114 to take further action, such as shutting down the electronic room air cleaner 100, blinking the LED 134, sounding an audible alarm (not shown), or automatically reducing the airflow, which activates a new set of speed limit set points.

The discharge counter 122 may be used instead of using the speed of the motor 104 to indicate a clogged electronic air cleaner filter 108. When the discharge counter 122 reaches a predetermined value (or when the frequency of popping or arcing on the electrode plates of the filter 108 exceeds a predefined limit), the control system can take one or more of the following actions: it can reduce the voltage across the power supply 120 which causes the frequency of popping or arcing to reduce; it can instruct the motor 104 to reduce the airflow; it can shut down the unit 100 if the frequency of popping becomes unacceptable; or it can activate the LED 134. The control system 114 can adjust the voltage across the power supply 120 as a function of the frequency of pops counted by the discharge counter 122 to make the unit run more efficiently.

What is claimed is:

1. A room air cleaner comprising:

a motor;

an electronic air cleaner filter which presents a variable resistance to airflow;

a blower connected to said motor for maintaining an airflow through said filter; and an airflow regulator operatively associated with said motor for maintaining the flow rate of the airflow through said filter at a substantially constant, nonzero value despite variations in said resistance to airflow, the airflow regulator including a discharge counter counting the frequency of pops occurring across the filter to determine a discharge counter value, the regulator adjusting the electronic air cleaner filter responsive to the discharge counter value.

2. The room air cleaner of claim 1 wherein said motor has at least one of an adjustable speed parameter and an adjustable airflow parameter.

3. The room air cleaner of claim 2 further comprising a control system element for controlling at least one of said adjustable speed parameter and said adjustable airflow parameter of said motor.

4. The control system element of claim 3 further comprising an LED that illuminates when the speed of said motor exceeds a preprogrammed value.

5. The control system element of claim 3 further comprising a mode selector having a residential and commercial mode.

6. The control system element of claim 3 further comprising a day/night selector having a day and night mode.

7. The control system element of claim 3 further comprising a timer element for adjusting at least one of said adjustable speed and airflow parameters of said motor after a preprogrammed period of time.

8. The control system element of claim 3 further comprising an airflow selector for adjusting the nominal airflow of said motor.

9. The room air cleaner of claim 3 wherein said filter is a high voltage electronic air filter further comprising an adjustable high voltage power supply for controlling the voltage across said high voltage electronic air filter.

10. The room air cleaner of claim 3 wherein said filter is a high voltage electronic air filter further comprising a discharge counter for measuring the frequency of discharge pops across said high voltage electronic air filter.

11. The control system element of claim 3 further comprising an LED that illuminates when the voltage across said high voltage electronic air filter falls below a preprogrammed value.

12. A room air cleaner comprising:

a motor including at least one of an adjustable speed parameter and an adjustable airflow parameter;

a high voltage electronic air filter which presents a variable resistance to airflow and includes a discharge counter for measuring the frequency of discharge pops across said high voltage electronic air filter;

a blower connected to said motor for maintaining an airflow through said filter; and an airflow regulator operatively associated with said motor for maintaining the flow rate of the airflow through said filter at a substantially constant, nonzero value despite variations in said resistance to airflow, the regulator including a control system element for controlling at least one of said adjustable speed parameter and said adjustable airflow parameter of said motor.

13. A room air cleaner providing a substantially constant nonzero airflow, said room air cleaner comprising:

at least one air inlet and at least one air outlet;

a motor;

a blower unit connected to said motor for drawing air from said inlet to said outlet;

a constant airflow regulator operatively associated with at least one of said motor and said blower for delivering a substantially constant, nonzero airflow from said inlet to said outlet despite changes in the flow resistance from said inlet to said outlet; and an electronic filter positioned for filtering the air drawn by said blower unit; wherein the regulator includes an adjustable high voltage power supply for controlling the voltage across the air filter and a discharge counter for measuring the frequency of discharge pops across the air filter, and the regulator adjusts the voltage based on the measured frequency of discharge pops.

* * * * *

UNITED STATES PATENT AND TRADEMARK OFFICE

CERTIFICATE OF CORRECTION

PATENT NO. : 6,066,194
DATED : May 23, 2000
INVENTOR(S) : Gordon J. Hugghins and Robert W. Helt It is certified that error appears in the above-identified patent and that said Letters Patent is hereby corrected as shown below:

Line 3, "acrcss" should read --across--.
Line 4, Line 52, "tie" should read -the--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*